United States Patent [19]

Jones et al.

[11] Patent Number: 4,676,222

[45] Date of Patent: Jun. 30, 1987

[54] RADIANT HEATERS

[76] Inventors: David Mervyn Jones, 4 Chantry Grove, Blaise Wood, Henbury, Bristol BS11 0QB; John K. Maund, 432 Quinton Road West, Birmingham B32 1QG, both of England

[21] Appl. No.: 659,216

[22] Filed: Oct. 10, 1984

[51] Int. Cl.[4] ..... F24C 3/00

[52] U.S. Cl. ..... 126/91 A; 126/92 B; 237/70; 219/347

[58] Field of Search ..... 126/91 R, 91 A, 92 B, 126/92 A; 237/70; 165/DIG. 6; 219/461, 347, 349

[56] References Cited

U.S. PATENT DOCUMENTS

| | | | |
|---|---|---|---|
| 3,237,679 | 3/1966 | Best | 126/92 B |
| 3,359,965 | 12/1967 | Milligan | 126/92 B |
| 4,269,590 | 5/1981 | Baumanns | 126/92 B |
| 4,319,125 | 3/1982 | Prince | 219/347 |
| 4,390,125 | 6/1983 | Rozzi | 237/70 |

FOREIGN PATENT DOCUMENTS

| | | | |
|---|---|---|---|
| 1119000 | 6/1956 | France | 237/70 |
| 436681 | 10/1935 | United Kingdom | 126/92 B |
| 543663 | 3/1942 | United Kingdom . | |
| 563095 | 7/1944 | United Kingdom . | |
| 577213 | 5/1946 | United Kingdom . | |
| 661919 | 11/1951 | United Kingdom . | |
| 1029774 | 5/1966 | United Kingdom | 126/92 B |
| 1110073 | 7/1968 | United Kingdom . | |
| 1119111 | 7/1968 | United Kingdom . | |
| 1315685 | 5/1973 | United Kingdom | 126/92 B |

OTHER PUBLICATIONS

Parabolic Reflector IR 75 HB Series Specification, Thermal Engineering Corp. (5-1964).

*Primary Examiner*—Margaret A. Focarino

[57] ABSTRACT

A radiant heater comprises first and second reflector portions (1, 2); first and second side reflector plates (3, 4); first and second end reflector plates (5, 6); first and second steel U-tubes (7, 8) received by the first and second portions (1, 2) respectively; end reflector plates (9, 11) for the reflector portion (1) and end reflector plates (10, 12) for the reflector portion (2), the ends of the tube (7) protruding through the plate (9) and the ends of the tube (8) protruding through the plate (10); first and second gas (or oil) burners and control units (13, 14) communicating with the ends of tubes (7, 8) respectively nearer a V-shaped channel; and first and second suction fan units (16, 17) communicating with the ends of tubes (7, 8) respectively which are further from the channel (15). In use of the heater, gas (or oil) is burnt at the burners and control units (13, 14), and hot air is sucked through the tubes (7, 8) by the suction fan units (16, 17). The provision of two U-tubes (7, 8) provides for a greater heat output than with the use of a single tube for a given length of heater and the provision of side reflector plates (3, 4) end reflector plates (5, 6, 9, 11, 10, 12) and the V-shaped channel (15) results in a reduced (and more uniform) spread of heat radiated by the tubes (7, 8) meaning that the heater may be disposed a greater height above ground to give a useful heating effect at ground level compared with a conventional radiant heater. Also, the overall shape of the radiant heater is such as to restrict the loss of heat due to convection.

10 Claims, 12 Drawing Figures

RADIANT HEATERS

BACKGROUND OF THE INVENTION

The heating of industrial buildings offers a considerable challenge to designers. If fuel is used to warm the air inside the building, then all air inside the building must be heated to provide a comfortable environment within the lower 2 meters—the area which is occupied by people.

By the very nature of warm air, it is less dense than the cooler air within the building and therefore the hot air leaving the heating source must rise. It is this occurrence which produces the wasteful stratification effect, where roof void temperatures can exceed the comfort level by as much as 20° C.

Heat losses from the roof area are, therefore, very high since the temperature gradient is increased by up to 20° C. In older buildings, where insulation values are much lower than today's modern structures with 0.7 $W/m^2$ values, up to 90% of the heat generated within the building when passed to air as the transmitting medium can be lost from the upper, warmer parts of the building.

Radiant heating can provide at least equal and in most cases improved comfort conditions with large energy savings over systems using warm air.

Radiation is one of the basic mechanisms by which energy is transferred between regions of different temperature. It is distinguished from other methods of heat transfer, conduction and convection, by the fact that it does not depend upon the presence of an intermediate material to act as a carrier of energy. On the contrary, energy transferred by radiation is impeded by the presence of a material in the space between. Energy transferred by radiation is the consequence of energy carrying electro-magnetic waves.

Energy transmitted by radiation is converted into heat when it is absorbed. The energy carrying electromagnetic waves must, therefore, strike solid objects in order to be converted into heat energy.

The rate of radiant energy emission by a surface is dependent upon its absolute temperature. The rate of emission from one body to another is governed by their different absolute temperatures and this relationship is determined using the Stefan Boltzmann Law.

Over the years, three distinct forms of radiant heating system have developed which operate in three distinct temperature bands.

(1) Low temperature 60°–175° C.
(2) Medium temperature 150°–450° C.
(3) High temperature 800°–950° C.

The low temperature range comprises all systems using water or steam as the initial heat transfer medium.

The medium temperature range uses electric sheathed elements or radiant tubes (direct fuel fired and recirculated hot air ducts with all black surfaces).

The high temperature range uses incandescent electric or gas heated surfaces.

LOW TEMPERATURE

Since, as a result of the Stefan Boltzmann law, radiant output is related to absolute temperature to the fourth power, the total heat output in a radiant form is low. Indeed, a greater proportion of the heat is given to convection. Since this is natural convection it can only rise and add very little to the comfort of a building at low level.

MEDIUM TEMPERATURE

Equipment designed for operation in this range has high combustion efficiencies and, because it operates below incandescent temperatures, can use steel as the heat transfer medium, which under the conditions used has an emissivity near to that of a black body. In this temperature band, the proportion of radiation to convection is much more favourable and represents optimum radiant efficiency because it is possible to use a large proportion of the heat of the combustion.

HIGH TEMPERATURE

This equipment is invariably in the form of a gas fired surface combustor. Whilst the peak radiant output is high due to incandescent temperatures, much of the heat cannot be extracted due to the high exhaust gas temperature (900° C. surface: 900° C. exhaust gas).

There will now follow a comparison of some medium temperature radiant heaters.

CENTRAL PLANT SYSTEMS

In these, using either a heat exchanger or direct fired unit, hot air is circulated within a duct-work system designed to run throughout a building to provide overall heating. Standard practice is to contain the ducts (about 15–75 cm and larger) within an insulated holding trunking having a central feed and twin return ducts positioned side by side. The duct-work, usually galvanized steel, is exposed on the underside and is often painted to improve its radiant efficiency. It is efficient, purpose designed and expensive, and cannot normally be used for 'zoned' applications, where heat is only required in a certain zone.

CONTINUOUS TUBE SYSTEMS

These comprise standard mild steel tubes with reflectors fitted above where appropriate, suspended at high level with individual burner units fitted at regular intervals. Combustion takes place within the tubes, the exhaust being extracted at the ends of the tube runs, although several runs can be interconnected. However, water condenses within the tubes and this must be drained. Zoned operation is possible but, under these circumstances, the relative efficiency drops. Such systems tend to be more costly to install than systems designed around 'unit' radiant tube heaters (see below).

Individual breakdown of a burner results in the lowering of the average surface temperature of that tube run with subsequent lowering of efficiency.

UNIT RADIANT TUBE HEATERS

There are a number of manufacturers producing heaters of this type. System design is acieved by using an appropriate number of individual units which can be interconnected electrically to provide excellent 'zoned' control, maximising fuel utilisation.

Most units comprise a U-tube radiator system, an atmospheric burner and exhaust fan, at respective ends of the limbs of the U-tube, the flame from the burner extending into one limb and the fan sucking out hot air from the other limb. Some burners are totally enclosed with fully automatic spark ignition and flame failure detection; also with a choice of air inlet including filters or duct spigot for external air entry. A reflector is fitted above the radiator tube.

Installation is relatively easy and costs are low. However, such systems hitherto cannot effectively be used above about 10 meters from floor level since they do not provide any significant heating at floor level when above about this height and their heat distribution at floor level is not always uniform.

SUMMARY OF THE INVENTION

According to the present invention from one aspect, there is provided a radiant heater, comprising:

(a) radiant heating means; and (b) a heat reflective housing which receives the radiant heating means, the housing comprising:

(c) a top reflector surface; and (d) first and second side reflector surfaces joined to the top reflector surface and extending below the radiant heating means by a distance which is at least 6 cm.

The housing could further comprise first and second end reflector surfaces joined to the top reflector surface and extending below the radiant heating means by a distance which is at least 6 cm.

The said distance could be in a range from 6 cm to about 2.5 meters.

The radiant heating means could comprise a tube; a burner communicating with one end of the tube; and suction means communicating with the other end of the tube for withdrawing hot air from the tube.

The top reflector surface could comprise first and second surface portions forming a channel between them which is substantially V-shaped in cross-section.

According to the present invention from another aspect, there is provided a radiant heater, comprising:

(a) a tube;

(b) a burner communicating with one end of the tube;

(c) suction means communicating with the other end of the tube for withdrawing hot air from the tube; and (d) a heat reflective housing which receives the tube, the housing comprising:

(e) first and second side reflector surfaces; and (f) a top reflector surface which is provided with a first, lower passageway above the tube, which communicates with the burner for supplying hot air thereto, and a second, upper passageway, above the first passageway, which communicates with the suction means for receiving exhaust air therefrom.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
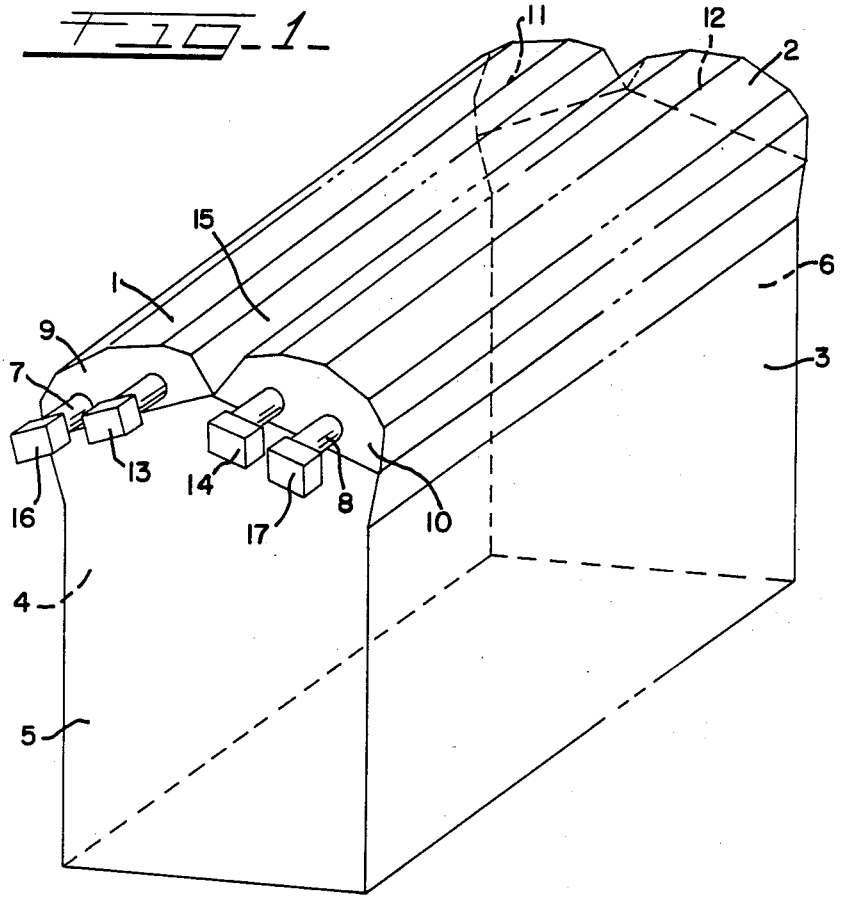
FIG. 1 is a schematic, perspective view of an example of a radiant heater according to the invention.

Referring first to FIG. 1, a radiant heater comprises first and second reflector portions 1 and 2; first and second side reflector plates 3 and 4; first and second end reflector plates 5 and 6; first and second steel U-tubes 7 and 8 received by the first and second portions 1 and 2 respectively; end reflector plates 9 and 11 for the reflector portion 1 and end reflector plates 10 and 12 for the reflector portion 2, the ends of the tube 7 protruding through the plate 9 and the ends of the tube 8 protruding through the plate 10; first and second gas (or oil) burners and control units 13 and 14 communicating with the ends of tubes 7 and 8 respectively nearer a V-shaped channel 15 between portions 1 and 2; and first and second suction fan units 16 and 17 communicating with the ends of tubes 7 and 8 respectively which are further from the channel 15. The portions 1 and 2 are made by bending plates of a suitable heat reflective metal such as aluminum and these portions and the side reflector plates 3 and 4, end reflector plates 5 and 6 and end reflector plates 9 and 11 and 10 and 12 (all of which are also made of such a heat-reflective metal) are assembled together by bolting, or riveting, or welding, and using appropriate metal brackets. The length of the heater is tyically at least 2 meters.

In use of the heater, gas (or oil) is burnt at the burners and control units 13 and 14, and hot air is sucked through the tubes 7 and 8 by the suction fan units 16 and 17. The provision of two U-tubes 7 and 8 provides for greater heat output than with the use of a single tube for a given length of heater and the provision of side reflector plates 3 and 4, end reflector plates 5 and 6 and end reflector plates 9 and 11 and 10 and 12 and the V-shaped channel 15 results in a reduced (and more uniform) spread of heat radiated by the tubes 7 and 8, meaning that the heater may be disposed a greater height above ground to give a useful heating effect at ground level compared with a conventional radiant heater. Typically, the radiant heater may be held at least 10 meters above the ground, (typically in the range from 15 meters to about 30 meters above the ground) to give a useful heating effect at the ground. Also, the overall shape of the radiant heater is such as to restrict the loss of heat due to convection.

Figure 2:
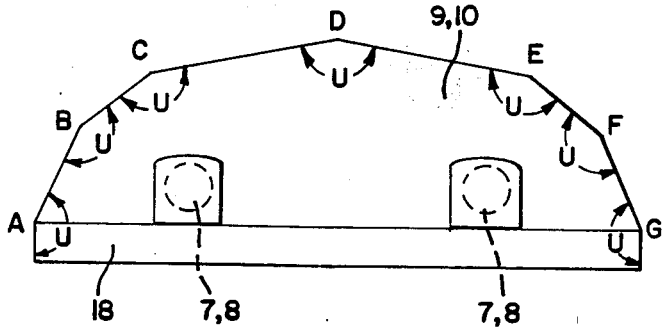
FIGS. 2 and 3 are details of what is shown in FIG. 1.

FIG. 2 shows one of the end reflector plates 9 and 10. The distances A-B and F-G are about 15 cms; the distances B-C and E-F are about 6.4 cms; the distances C-D and D-E are about 12.3 cms; and the distance A–G is about 61 cms. Each of the angles U is 154°. The distance between the centres of the limbs of the U-tube 7 or 8 is about 30.5 cms.

Reference numeral 18 denotes a box-section fastening bracket.

Figure 3:
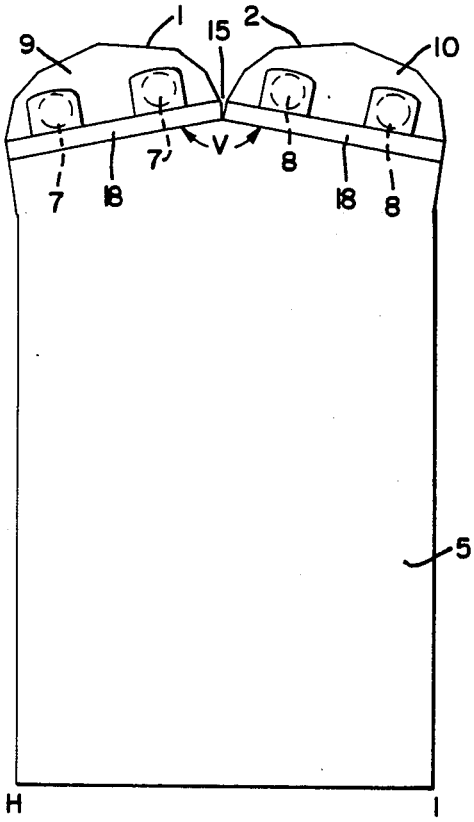

FIG. 3 is an end-view of the reflective housing comprising reflector portions 1 and 2, the side reflector plates and end reflector plates. The angle V (that is the angle between the line joining the centres of the limbs of the U-tube 7 and the line joining the centres of the limbs of the U-tube 8) is 160° and the distance H-I is about 1.1 meters.

There will now be described with reference to FIGS. 4, 5, 6, 7, 8, 9 and 10 alternative configurations for the reflective housing, each of these figures being an end view corresponding to FIG. 3. In each of the alternative configurations, the reflector portions 1 and 2 are structurally identical with the reflector portions 1 and 2 respectively of the foregoing embodiment.

Figure 4:
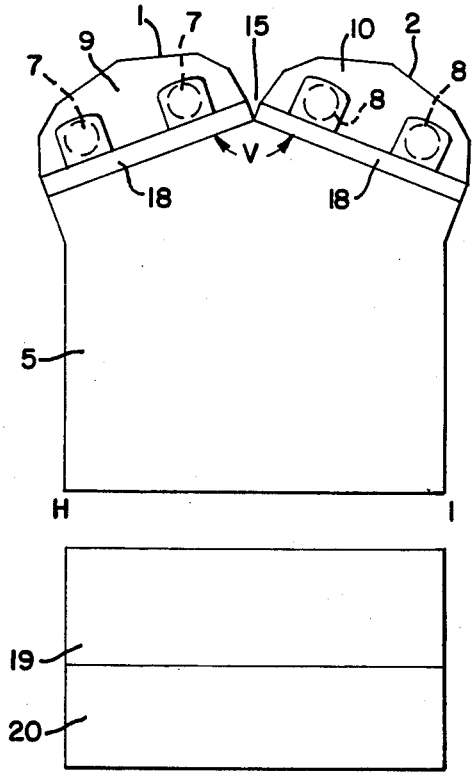
FIGS. 4 to 10 show alternatives to what is shown in FIG. 3.

In FIG. 4, the angle V is 140° and the distance H-I is about 1.04 meters. Reference numerals 19 and 20 denote extension plates for the end reflector plate 5, one or both of which may be fitted to the end reflector plate 5. There would, of course, be a corresponding extension plate or plates for each of the end reflector plate 6 and the side reflector plates 3 and 4. Each of extension plates 19 and 20 is about 61 cms by about 30.5 cms.

Figure 5:
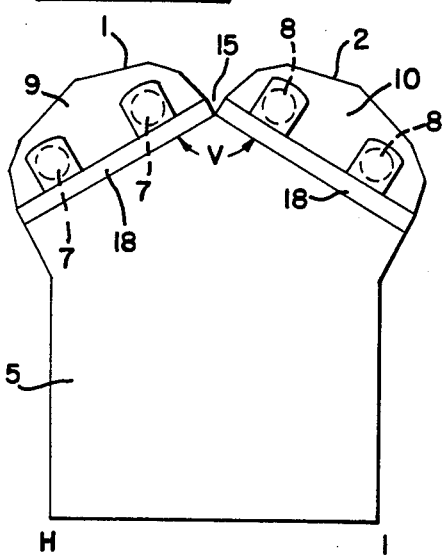

In FIG. 5, the angle V is 120° and the distance H-I is about 91.4 cms.

Figure 6:
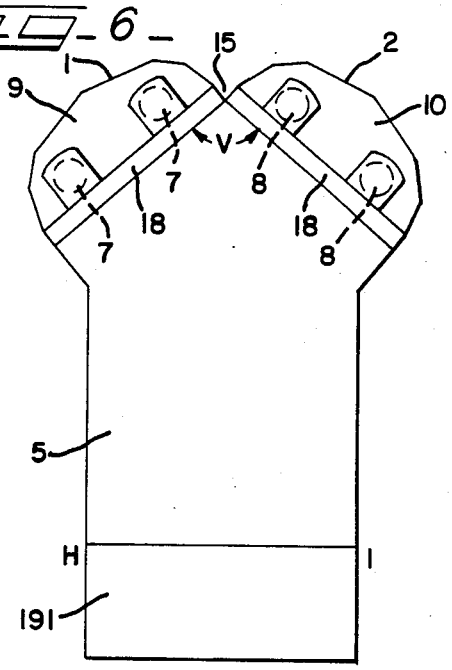

In FIG. 6, the angle V is 100° and the distance H-I is about 74.3 cms. Reference numeral 191 denotes an extension plate for the end reflector plate 5, which may be fitted if desired like the plate 19 of FIG. 4, and is about 74.3 by about 30.5 cms. If the plate 191 is provided, then of course, a further extension plate will be provided for each of the end plate 6 and side reflector plates 3 and 4.

Figure 7:
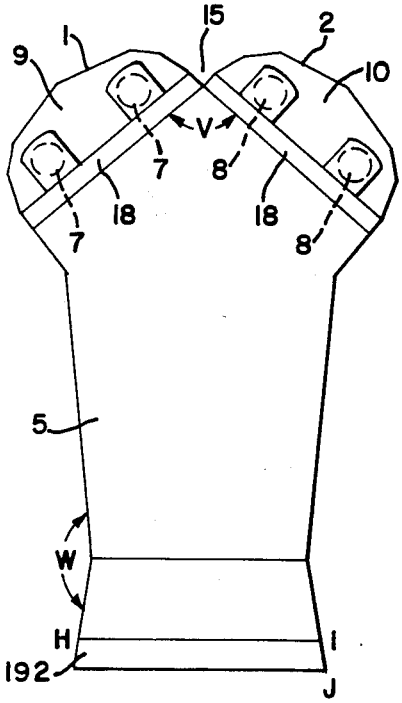

In FIG. 7, the angle W is 165° and the distance H-I is about 68.6 cms. Reference numeral 192 designates an end reflector extension plate which may be added on if desired, together with an extension plate for the end plate 6 and extension plates for the side reflector plates 3 and 4. The distance I-J is about 7.62 cms.

Figure 8:
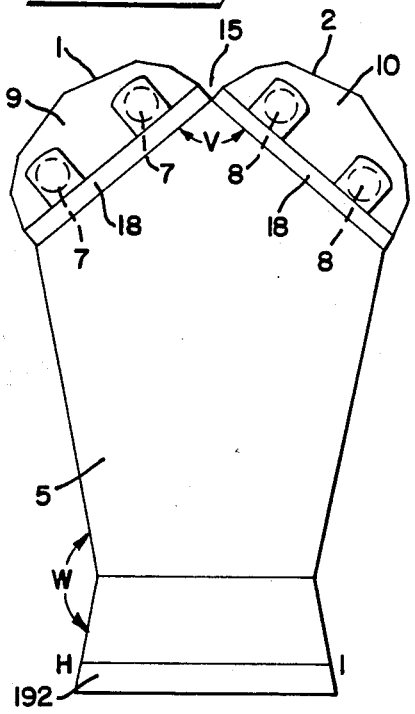

FIG. 8 shows a configuration identical with that of FIG. 7 except for the shape of the end reflector plate 5 (and hence the end reflector plate 6 and side reflector plates 3 and 4), the angle W being 160°.

Figure 9:
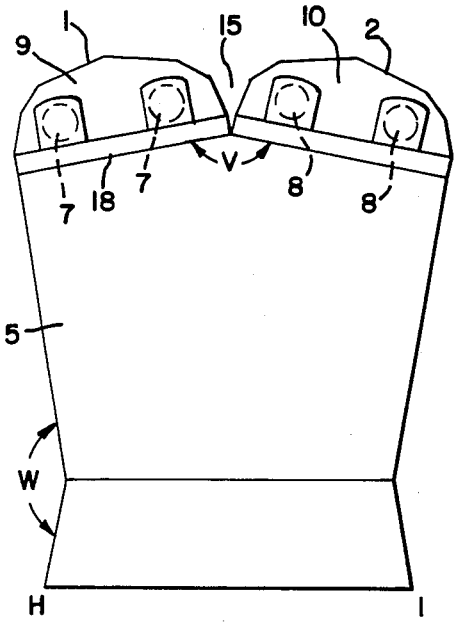

In FIG. 9, the angles V and W are 160° and the distance H-I is about 1.03 meters.

Figure 10:
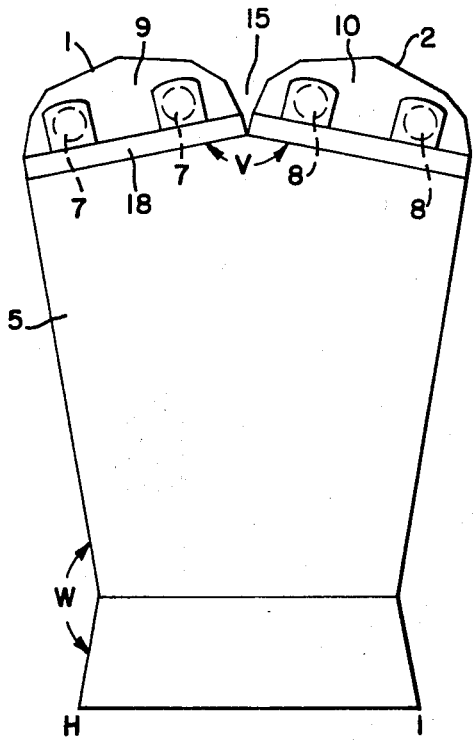

The configuration of FIG. 10 is identical with that of FIG. 9, the angles V and W agan being 160°, but the end reflector plate 5 is somewhat longer, the distance H-I being about 99.1 cms.

In the above embodiments, there are different values for the angle V. As a general rule, it may be stated that preferably, the angle V is in the range from 90° to 180°.

Figure 11:
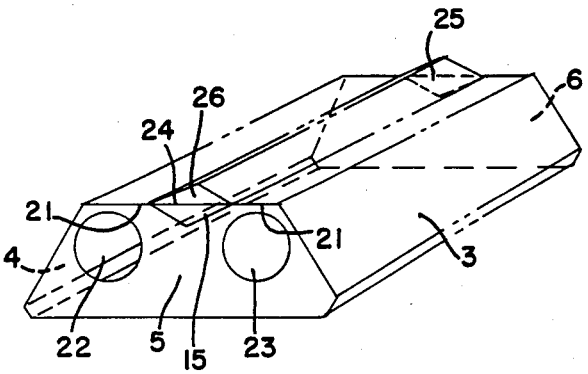
FIG. 11 is a perspective view of the reflective housing of a further example of a radiant heater according to the invention.
Figure 12:
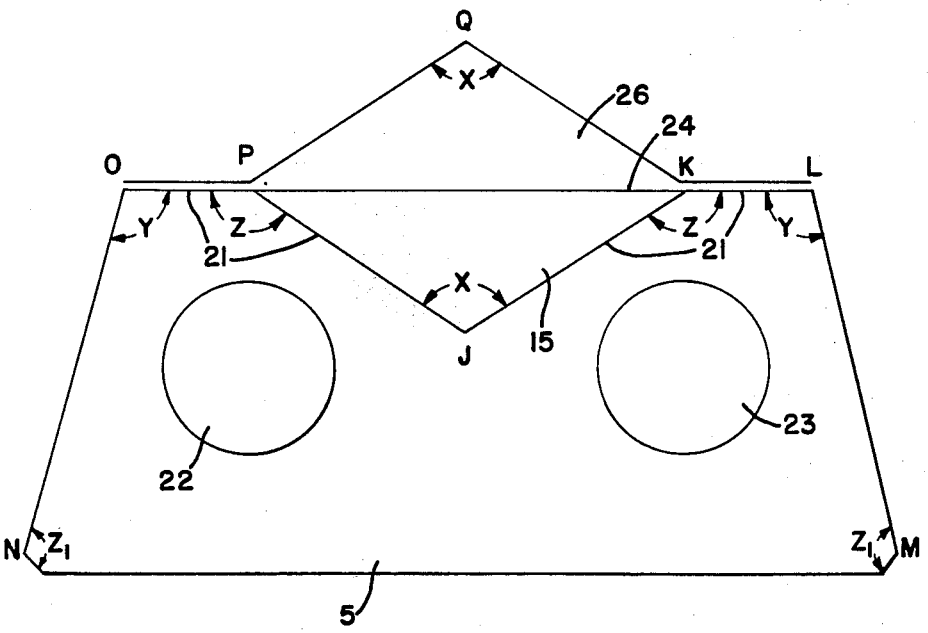
FIG. 12 shows an enlarged end detail of what is shown in FIG. 11.

There will now be described an embodiment using just a single U-tube which, again, provides a greater and more uniform radiant heat output than a conventional radiant heater using a single U-tube. Referring to FIG. 11, the reflective housing for the U-tube (not shown) comprises a housing made from the heat-reflective metal such as aluminum in the form of: a first plate section bent to provide side reflector walls 3 and 4 with a top reflector portion 21 between them, the portion 21 being formed to have a V-shaped channel 15; and end reflector plates 5 and 6, the plate 5 having openings 22 and 23 therein for the limbs of the U-tube. The housing further includes, a plate 24 made of the same material which covers the channel 15; and fitted on top of plate 21, a plate 25 bent to form a further-channel 26, above the channel 15. The housing is held together by bolting or riveting, or welding and using suitable brackets. Again, the housing has a minimum length of about 2 metres and, referring to FIG. 12, the distance K-L and O-P are about 7.6 cms; the distances L-M and O-N are about 21.6 cms; the distance J-Q is about 15.9 cms; the distances P-J and J-K are about 15.2 cm; the angle X is 116°; the angle Y is 115°; the angle Z is 148°; the angle Z1 is 120°. The channel 15 communicates with the burner for supplying pre-heated air thereto and the channel 26 communicates with the suction fan unit for receiving exhaust air therefrom.

In all the foregoing embodiments, the side and end reflector surfaces extend at least 6 cm below the lowest point(s) of the U-tube(s).

We claim:

1. A radiant heater comprising,

A. heat reflective housing means,

B. said heat reflective housing means including, i. top reflector surface means having, a first reflector section, and a second reflector section, ii. said first reflector section and said second reflector section disposed at a predetermined angle to each other to concentrate the strength of the heat radiating from said heat reflective housing means, and iii. first and second side reflector surfaces and first and second end reflector surfaces operatively connected to the lower section of said top reflector surface means and depending therefrom in a range from 6 cm to about 1.1 meters, and C. radiant heating means connected in the top reflector surface means of the heat reflective housing means.

2. A radiant heater as claimed in claim 1 wherein the predetermined angle at which the first reflector section and the second reflector section are disposed with respect to each other is in a range from 90° to 180°.

3. A radiant heater as claimed in claim 1 including,

A. side extension plates and end extension plates disposed for connection to the lower end of the first and second side reflector surfaces and first and second end reflector surfaces respectively, and B. said side extension plates and said end extension plates depending from the lower end of the side reflector surfaces and end reflector surfaces a length in a range from 7.62 cms to 30.5 cms.

4. A radiant heater as claimed in claim 3 wherein,

A. the first and second side reflector surfaces converge towards each other,

B. the side extension plates diverge from each other from the point of connection to the respective first and second side reflector surfaces, and C. the first and second side reflector surfaces and the coacting side extension plates are at an angle with respect to each other in a range from 160° to 165°.

5. A radiant heater as claimed in claim 1 wherein,

A. said first reflector section and second reflector section each having a predetermined plurality of sides disposed at a predetermined angle with respect to each other, and B. said first reflector section and said second reflector section define a v-shaped channel on the exterior surface of the heat reflector housing means.

6. A radiant heater as claimed in claim 5 wherein the predetermined plurality of sides define angles of about 154°.

7. A radiant heater as claimed in claim 1 wherein,

A. said first reflector section and second reflector section each have a predetermined plurality of sides disposed at a predetermined angle with respect to each other, B. said first reflector section and said second reflector section define a V-shaped channel in the exterior surface of the heat reflector housing means, C. heat exchange plate means connected to the exterior surface of the heat reflector housing means to define a first passage means extending the longitudinal length of the said top reflector surface means, and D. top plate member means having an inverted V-shaped channel formed along the longitudinal length thereof so connected to said heat exchange plate means as to define therewith a longitudinally extending second passage means on the exterior of the heat reflective housing means on the side thereof opposite from the passage means.

8. A radiant heater as claimed in claim 4 wherein the V-shaped channel and the inverted V-shaped channel are disposed opposite each other and have a predetermined angle of 116°.

9. A radiant heater as claimed in claim 4 wherein

A. the said first reflector section and second reflector section have oppositely disposed side reflecting members thereon, B. said side reflecting members are a predetermined distance from the V-shaped passage and are disposed to diverge from each other, and C. said side reflecting members depend from the top reflector surface means at least 6 cms.

10. A radiant heater comprising,

A. heat reflective housing means,

B. said heat reflective housing means including, i. top reflector surface means having, a first reflector section, and a second reflector section, ii. said first reflector section and said second reflector section disposed to form a V-shaped channel on the exterior side of said top reflector surface means, iii. heat exchange plate means connected to the exterior of the top reflector surface means and operatively associated with the V-shaped channel to define a first passage means extending the longitudinal length of said top reflector surface means, and C. top plate member means having an inverted V-shaped channel formed along the longitudinal length thereof connected to said heat exchange plate means on the side thereof opposite from the V-shaped channel to define a longitudinally extending second passage means on the exterior of said heat reflective housing means, D. radiant heating means connected in the top reflector surface means having a single U-tube means which extends at either end from the heat reflective housing means, E. burner means communicating with one end of the said U-tube means, and suction means communicating with the opposite end of the U-tube means for withdrawing hot air from the tube, F. said first passage means connected to the burner means for supplying preheated air thereto, and G. said second passage means connected to the suction means for exhausting hot air therefrom.

* * * * *